US011135488B2

(12) United States Patent
Rice

(10) Patent No.: US 11,135,488 B2
(45) Date of Patent: Oct. 5, 2021

(54) MULTI-PURPOSE GOLF TEE

(71) Applicant: Eric E. Rice, Pleasant Hill, IA (US)

(72) Inventor: Eric E. Rice, Pleasant Hill, IA (US)

( * ) Notice: Subject to any disclaimer, the term of this patent is extended or adjusted under 35 U.S.C. 154(b) by 0 days.

(21) Appl. No.: 16/519,801

(22) Filed: Jul. 23, 2019

(65) Prior Publication Data

US 2020/0030674 A1 Jan. 30, 2020

Related U.S. Application Data

(60) Provisional application No. 62/702,478, filed on Jul. 24, 2018.

(51) Int. Cl.
*A63B 57/10* (2015.01)
*A63B 57/60* (2015.01)
*A63B 57/50* (2015.01)

(52) U.S. Cl.
CPC ..... *A63B 57/10* (2015.10); *A63B 57/50* (2015.10); *A63B 57/60* (2015.10)

(58) Field of Classification Search
CPC ..... A63B 57/60; A63B 57/10; A63B 57/12; A63B 57/13; A63B 57/15; A63B 57/16; A63B 57/18; A63B 57/19; A63B 57/50
USPC ..... D21/717; 273/157 R
See application file for complete search history.

(56) References Cited

U.S. PATENT DOCUMENTS

D67,255 S * 5/1925 Alvord ..... D21/718
1,638,527 A * 8/1927 Clausing ..... A63B 57/10 473/402
1,656,401 A * 1/1928 Totten ..... A63B 57/10 473/402
1,671,813 A * 5/1928 Clarke ..... A63B 57/10 473/403
2,953,380 A * 9/1960 Hassenbach ..... A63F 9/10 273/157 R
3,347,551 A * 10/1967 Dreyfus ..... A63B 57/19 473/257
D219,347 S * 12/1970 Letts, Jr. ..... D21/718
3,782,723 A * 1/1974 Morris ..... A63B 57/10 473/403
3,819,188 A * 6/1974 Freedman ..... A63F 9/12 273/160
4,948,130 A * 8/1990 Rydborn ..... A63B 57/10 473/391
5,193,803 A * 3/1993 Flick, III ..... A63B 57/10 473/392
5,195,743 A * 3/1993 Walsh, Jr. ..... A63B 57/10 473/401
5,212,842 A * 5/1993 Glydon ..... A63H 33/04 428/44
D376,182 S * 12/1996 Lusk ..... D21/718
5,605,332 A * 2/1997 Harnett ..... A63F 9/10 273/157 R
5,738,598 A * 4/1998 Wu ..... A63B 57/19 473/392

(Continued)

*Primary Examiner* — Steven B Wong
(74) *Attorney, Agent, or Firm* — Zarley Law Firm, P.L.C.

(57) ABSTRACT

A multi-purpose tee has a head that terminates into an elongated shaft. The head has a first sidewall and a second sidewall that are joined. The first sidewall has a flat inner surface and an outer surface that angles inwardly from a top edge as the outer surface extends toward the shaft. The second sidewall is cone or bowl shaped and creates a space between the first and second sidewall. The shaft has a first surface, a second surface, a square end and sides.

13 Claims, 3 Drawing Sheets

(56) References Cited

U.S. PATENT DOCUMENTS

| | | | | | |
|---|---|---|---|---|---|
| 6,010,413 | A * | 1/2000 | Pan-Chung | A63B 57/10 | 473/402 |
| 6,033,746 | A * | 3/2000 | Morris | A63F 9/10 | 428/33 |
| 6,086,067 | A * | 7/2000 | Benoit | A63F 9/12 | 273/157 R |
| 6,280,350 | B1 * | 8/2001 | Chung | A63B 57/10 | 473/387 |
| 8,029,387 | B2 * | 10/2011 | Breton | A63B 57/10 | 473/387 |
| D776,213 | S * | 1/2017 | Breton | D21/718 | |
| 10,035,056 | B1 * | 7/2018 | Ogando | A63B 57/10 | |
| 2003/0148830 | A1 * | 8/2003 | Hsiao | A63B 57/50 | 473/387 |
| 2004/0204268 | A1 * | 10/2004 | Hsien | A63B 57/10 | 473/396 |
| 2006/0199669 | A1 * | 9/2006 | Barouh | A63B 57/10 | 473/398 |
| 2007/0129177 | A1 * | 6/2007 | Harris | A63B 57/19 | 473/387 |
| 2013/0190101 | A1 * | 7/2013 | Mabrey | A63B 57/19 | 473/257 |
| 2013/0337943 | A1 * | 12/2013 | Elliot | A63B 57/10 | 473/387 |
| 2016/0166898 | A1 * | 6/2016 | Dastrup | A63B 57/19 | 473/402 |
| 2018/0280773 | A1 * | 10/2018 | Whalen | A63B 57/19 | |
| 2020/0030674 | A1 * | 1/2020 | Rice | A63B 57/10 | |

* cited by examiner

MULTI-PURPOSE GOLF TEE

CROSS REFERENCE TO RELATED APPLICATION

This application claims the benefit of the priority of U.S. Provisional Application No. 62/702,478 filed on Jul. 24, 2018, the contents of these applications are hereby incorporated by reference in their entirety.

BACKGROUND OF THE INVENTION

This invention is directed to a tee made for golfing and more particularly a golf tee that is adapted to perform different functions.

Golf tees are well known in the art and primarily are used to permit a golfer to hit a ball in a raised position. Typically a tee has a bowl like head for receiving a ball and a shaft for insertion into the ground. The shaft typically is round and comes to a point. While some golfers may use a tee to fix ball divots, because of the round surface, the tees are not efficient in filling the divot. Also, some golfers use the point of the tee to clean the grooves on a club but because the point is not designed to be received within the groove, the tee is not efficient in cleaning the grooves. Accordingly, there is a need in the art for a device that addresses these deficiencies.

An objective of the present invention is to provide a golf tee capable of use for multiple purposes.

Another objective of the present invention is to provide a golf tee that more efficiently cleans clubs.

These and other objectives will be apparent to those having ordinary skill in the art based upon the following written description, drawings, and claims.

SUMMARY OF THE INVENTION

A multi-purpose golf tee has a head that terminates in a shaft. The head has a first sidewall that has a flat inner surface and an angled outer surface. The first sidewall is connected to a second sidewall that is spherical in shape to form a partial bowl in the space between the sidewalls. Extending outwardly in a horizontal plane perpendicular to the first sidewall are a pair of spaced prongs that are pointed at the end. A raised lip is positioned on the top edge of the second sidewall. Alternatively, a plurality of vertical prongs are spaced about the top edge of the first and second sidewall.

The shaft has a first surface, an opposite second surface, a squared end, and sides. The first surface dwells in the same plane as the inner surface of the first sidewall of the head and the second surface dwells in the same plane as the outer surface of the first sidewall of the head.

DETAILED DESCRIPTION OF THE PREFERRED EMBODIMENTS

Figure 1:
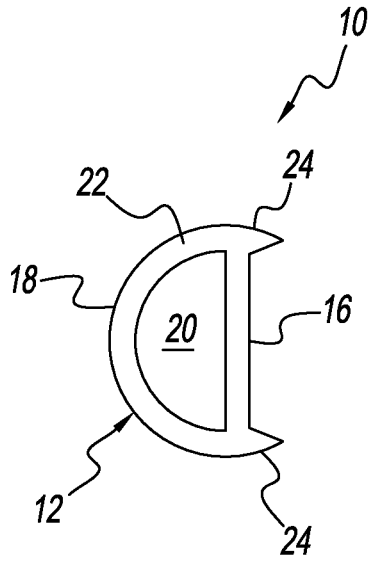
FIG. 1 is a top plan view of a multi-purpose golf tee.
Figure 2:
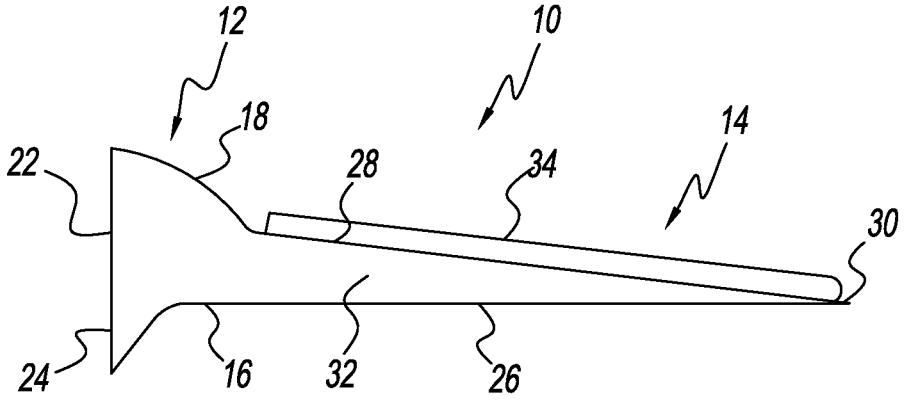
FIG. 2 is a side view of a multi-purpose golf tee.
Figure 3:
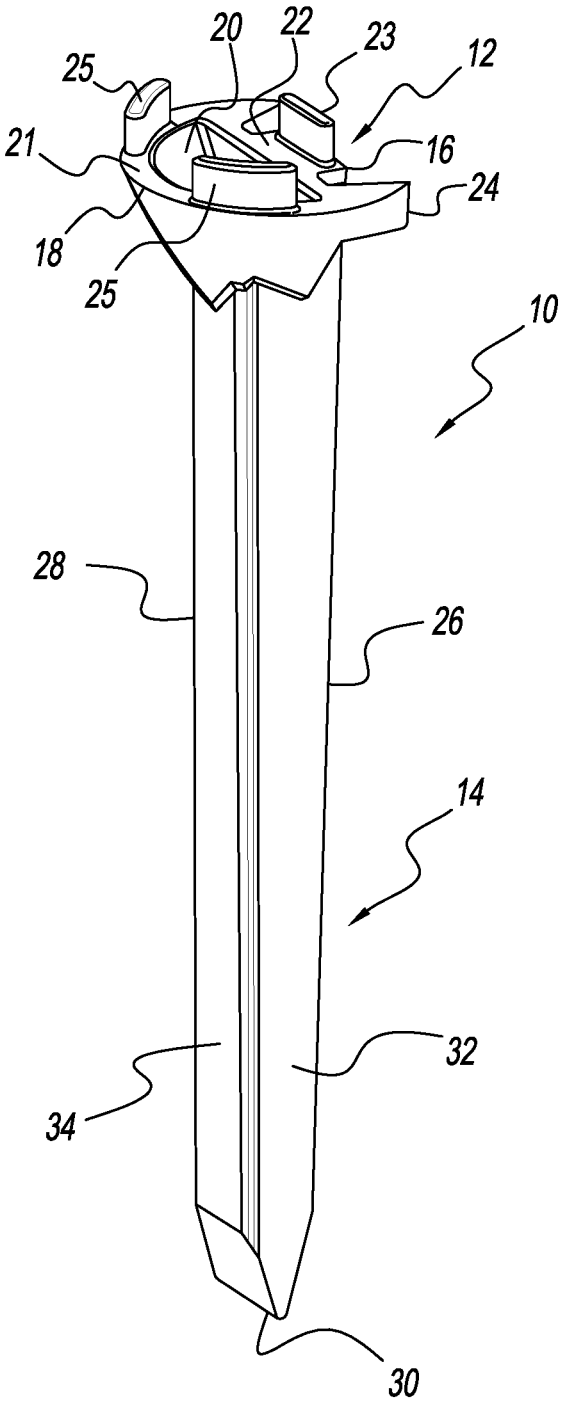
FIG. 3 is a perspective view of a multi-purpose golf tee.

Referring to the figures, a multi-purpose golf tee 10 has a head 12 and a shaft 14. The head 12 has a first sidewall 16 that is generally flat and triangular and a second sidewall 18 that has a cone-like shape to form a partial sphere or bowl. The space 20 between the sidewalls 16 and 18 is hollow or can be filled.

Extending outwardly from the first sidewall 16 and dwelling in the same plane as the top edge 22 of the head 12 are a pair of spaced prongs 24. The prongs 24 are spaced to fit within grooves on a golf club (not shown). The head 12 terminates in the shaft 14 which extends downwardly from the head 12. To assist with ball balance, in one embodiment the head 12 has raised tabs 21 on a top edge 22 of the second sidewall 18. The head 12 can also be tapered meaning that the top edge 22 tapers downwardly toward the shaft.

Figure 4:
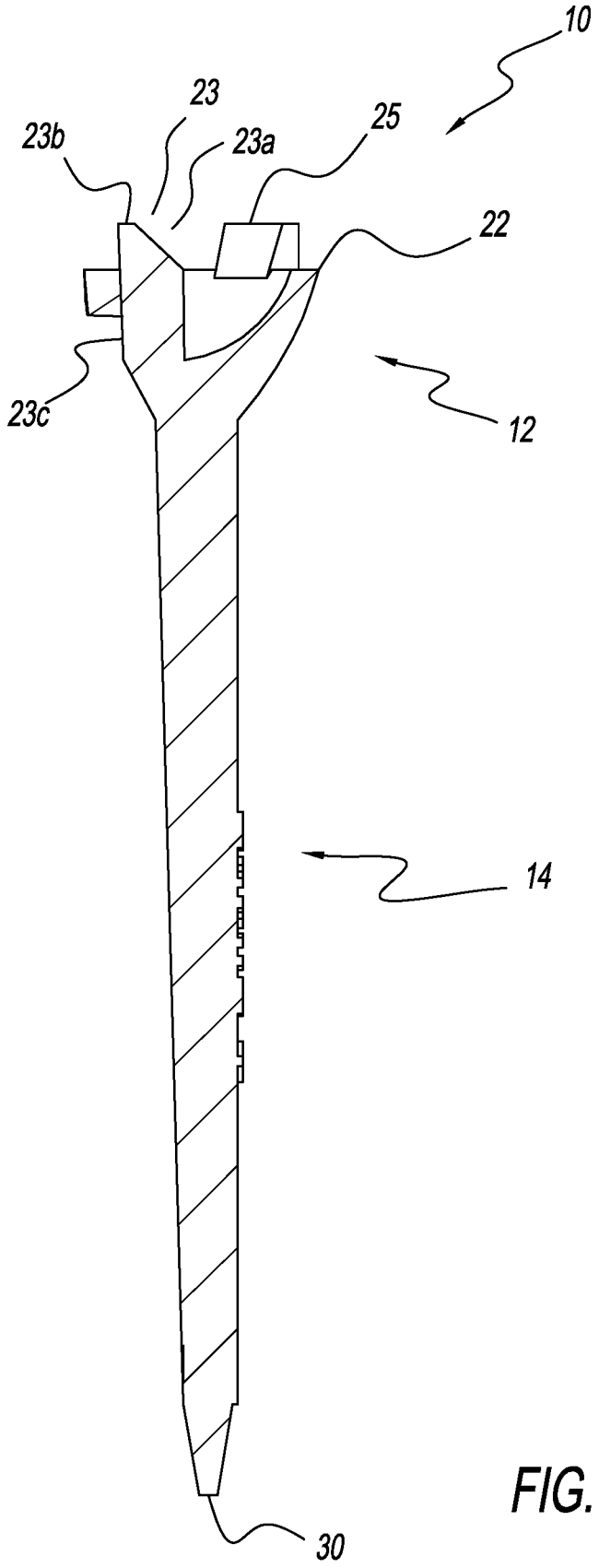
FIG. 4 is a side sectional view of a multi-purpose golf tee.

Alternatively, as shown in FIG. 4, the tee 10 has a first vertical prong 23 that is positioned between prongs 24 and extends vertically off the top edge 22 of the head 12. Preferably, the first prong 23 has an inner wall 23*a* that is angled as the inner wall 23*a* extends from the first sidewall 16 to a point or apex 23*b* of the first prong 23. An outer wall 23*c* of the first prong 23 extends vertically downward from the point 23*b* and then angles inwardly toward the shaft 14. The shape of the outer wall 23*c* of the first prong 23 provides far better gripping and leverage when fixing divots. Spaced arcuate prongs 25 extend vertically and upwardly from the second sidewall 18 and dwell in the same plane as the second sidewall 18. The prongs provide clear displacement of the ball from the tee.

The shaft 14 has a first surface 26, a second surface 28, an end 30, and sides 32. The first surface 26 is flat and dwells in the same plane as the first sidewall 16. The tip 30 is as sharp as can be and is either less than 30 mils or between 30 and 40 mils in width. The second surface 28 tapers downwardly as it extends from the head 12 to the end 30 of the shaft 14 which provides a triangular or alternatively trapezoidal profile for the sides 32. The end or tip 30 is squared or perpendicular to the sides 32 and is configured to fit within the grooves of a golf club. In one example, the second surface 28 has a rib 34 that extends down the shaft 14. To assist in alignment, a vertical stripe is printed on the first surface 26. Also indicia such as a name, logo, or the like is printed on the first surface 26 and/or second 28 surface or wording is included as part of the mold. Alternatively, the shaft 14 extends outwardly away from the head between the prongs 24.

In operation, the tee 10 is used in many ways. First, the end 30 of the shaft 14 is inserted into the ground and a ball is placed on the top edge 22 of the head permitting one to strike a ball in a raised position. The tee 10 also is used to fix ball divots on a green. More specifically, the end 30 of the shaft 14 is inserted at an angle around the perimeter of the divot and then, using manual force the angle of the shaft 14 is changed filling the divot with surrounding sand and/or dirt. The squared end 30 and the rectangular shaft 14 provides a wider surface to fill the divot compared to a conventional tee.

Finally, the tee 10 is used to clean the grooves on a club and the spikes on one's shoes. The grooves are cleaned by placing the prongs 24 in the grooves and sliding the prongs 24 along the grooves to remove debris. The end 30 also can be inserted into the groove and slid along the groove to remove debris. The end 30 also is used similar to a pick to remove dirt and grass from the spikes of one's shoes.

From the above discussion and accompanying figures and claims it will be appreciated that the multi-purpose golf tee 10 offers many advantages over the prior art. It will be appreciated further by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A multi-purpose golf tee, comprising:

a head having a first sidewall that is flat and a second sidewall;

a first vertical prong that extends vertically from the first sidewall;

a pair of spaced apart arcuate prongs that extend vertically from the second sidewall;

a pair of parallel spaced prongs dwell in the same plane as a top edge of the first sidewall and extend perpendicular and outwardly away from opposing endpoints of the first sidewall.

2. The tee of claim 1 further comprising the first vertical prong having an inner wall that extends inwardly and downwardly in relation to the first sidewall.

3. The tee of claim 2 further comprising an outer wall of the first prong extends vertically downwards and then angles inwardly toward a shaft.

4. The tee of claim 1 further comprising the pair of parallel spaced prongs each terminating at a pointed end.

5. The tee of claim 1 wherein a space between the first sidewall and the second sidewall is hollow.

6. The tee of claim 1 wherein a space between the first sidewall and the second sidewall is solid.

7. The tee of claim 1 wherein the second sidewall has a raised lip.

8. The tee of claim 1 further comprising a shaft, wherein the shaft has a first surface, a second surface, a squared end, and sides.

9. The tee of claim 8 wherein the first surface of the shaft has printed indicia.

10. The tee of claim 8 wherein the first surface of the shaft dwells in the same plane as the flat first sidewall of the head.

11. The tee of claim 8 wherein the second surface angles away from the first surface as the shaft extends away from the squared end to the head.

12. The tee of claim 8 wherein the second surface has a rib that extends along a length of the shaft.

13. The tee of claim 1 further comprising a shaft having a first flat surface, a second flat surface, a first flat side that extends between the first flat surface and the second flat surface, and a second flat side that extends between the first flat surface and the second flat surface.

* * * * *